US007042324B2

(12) United States Patent
Watanabe

(10) Patent No.: US 7,042,324 B2
(45) Date of Patent: May 9, 2006

(54) SURFACE MOUNT INDUCTOR

(75) Inventor: Yoshito Watanabe, Misato (JP)

(73) Assignees: Sumida Corporation, Tokyo (JP); Sumida Electric Co., Ltd., Tokyo (JP)

( * ) Notice: Subject to any disclaimer, the term of this patent is extended or adjusted under 35 U.S.C. 154(b) by 0 days.

(21) Appl. No.: 10/874,067

(22) Filed: Jun. 22, 2004

(65) Prior Publication Data

US 2005/0001705 A1 Jan. 6, 2005

(30) Foreign Application Priority Data

Jul. 1, 2003 (JP) ..... 2003-270140

(51) Int. Cl.
*H01F 27/30* (2006.01)

(52) U.S. Cl. ..... 336/192

(58) Field of Classification Search ..... 336/65, 336/83, 90, 192, 198, 200, 232
See application file for complete search history.

(56) References Cited

U.S. PATENT DOCUMENTS 4,754,370 A * 6/1988 DeTizio et al. ..... 361/772
5,212,345 A * 5/1993 Gutierrez ..... 174/52.5
5,307,041 A * 4/1994 Kato et al. ..... 336/83
5,751,203 A * 5/1998 Tsutsumi et al. ..... 336/65
6,570,478 B1 * 5/2003 Meeks ..... 336/229

FOREIGN PATENT DOCUMENTS

JP 10-22137 A 1/1998

* cited by examiner

*Primary Examiner*—Tuyen T Nguyen
(74) *Attorney, Agent, or Firm*—Reed Smith LLP

(57) ABSTRACT

A surface mount inductor has a drum core, a winding to be wound around a winding shaft section of the drum core, a case body of a nonconductive material to be disposed to surround the winding, a binding terminal fixed to the case body and protruding radially outward from the case body to be bound a winding terminal to, and a metal terminal member having a planar terminal to be a contact portion with a substrate when the surface mount inductor is surface mounted on the substrate. The inductor includes an extended portion protruding radially outward from the case body and having a wider width than or approximately the same width as of the binding terminal, the extended portion being disposed at a overlapping position with the binding terminal in a height direction of the drum core. The winding terminal is wound around from the outer peripheral side of both the binding terminal and the extended portion.

4 Claims, 4 Drawing Sheets

SURFACE MOUNT INDUCTOR

BACKGROUND OF THE INVENTION

1. Field of the Invention

The present invention relates to a thin inductor suitable such as for a driving circuit of a backlight of a liquid crystal display screen of a portable terminal device.

2. Description of the Related Art

Conventionally, there exist inductors of a surface mount type which are structured such that a winding is wound around a winding shaft of a drum core of the inductor, and that a planar terminal is attached to one of flange sections of the drum core (refer to Japanese Patent Application Laid-Open No. Hei 10-22137 (FIG. 2 etc.)). For instance, according to the inductor described in the above application, there is provided a binding terminal being an outer peripheral end of the planar terminal formed by being bent to be orthogonal to the planar terminal. A winding terminal is bound around the binding terminal.

Conventionally, the inductors to be built in a portable terminal device have been required to be thin and drop resistant due to characteristics of the portable terminal device. With an aim to respond to the requirement, such an inductor that adopts the drum core to thereby allow reduction in vertical size, i.e. height size, and that is to be surface mounted on a substrate is frequently used for the portable terminal device.

SUMMARY OF THE INVENTION

In the inductor employing the drum core, there arises a problem of causing a flaw in the binding terminal for binding the winding terminal such as when receiving an impact ascribable to production or a drop or the like of the inductor. Due to the impact, the binding terminal is broken or bent to suffer the flaw. Conventionally, in the inductor of a surface mount type, the binding terminal is formed protrude radially outward to curb its vertical size. In such a structure, the binding terminal is possibly broken off due to an accidental hit by a jig or a hand in the course of an assembling work or the like.

It should be noted that, in the inductor described in the above application, the binding terminal is bent to extend in the vertical direction so that the binding terminal is structured to be hard to suffer a trouble such as a broken damage from an accidental work operation.

Meanwhile, the binding terminal in the application is extended in the vertical direction, making it difficult to lower its vertical size, and a binding operation of the wiring becomes harder than that of the binding terminal being protruded in the outer peripheral direction.

Incidentally, in this inductor of a built-in type for the portable terminal device, an extra fine winding (specifically, approximately 0.35 mm) is used. Hence, when winding a wire terminal i.e. an end portion of the wire to the binding terminal, as an additional problem, there easily arises a cutting of the winding terminal caused by a strong osculation of the winding to an edge of the binding terminal or by a friction of the wiring against the edge.

In consideration of the above-mentioned problems, it is an object of the present invention to provide a surface mount inductor of which binding terminal is free from a break or the like and a winding terminal rarely suffers a cutting caused by an edge of the binding terminal, and which allows reduction in height size.

In view of the above-mentioned problems, a surface mount inductor according to the present invention having a drum core, a winding to be wound around a winding shaft section of the drum core, a case body of a nonconductive material to be disposed so as to surround the winding, a binding terminal fixed to the case body and protruding radially outward from the case body to be bound a terminal of the winding to, and a metal terminal member having a planar terminal to be a contact portion with a substrate when the surface mount inductor is surface mounted on the substrate includes an extended portion protruding radially outward from the case body and having a wider width than or approximately the same width as of the binding terminal, the extended portion being disposed at a overlapping position with the binding terminal in a height direction of the drum core, in which the winding terminal is wound around from the outer peripheral side of both the binding terminal and the extended portion.

In another invention, the above-described surface mount inductor includes a hook portion for preventing the winding terminal from slipping, which is provided at a radially outward end portion of the extended portion.

In still another invention, the above-described surface mount inductor includes a fixing surface for adhesively fixing the drum core by abutting from radially outside to a flange section of the drum core, which is provided at an end portion of the case body opposite to the end portion to which the metal terminal member is to be fixed.

According to the surface mount inductor of the present invention, a break or the like of the binding terminal is hard to occur, and a cutting of the winding terminal caused by the edge of the binding terminal is hard to occur.

More specifically, according to the above-described invention, it is structured such that an extended portion is provided at an overlapping position with a binding terminal in the vertical (height) direction of the drum core and the winding terminal is wound around both the binding terminal and the extended portion from their outside, so that the winding terminal does not osculate the binding terminal at an acute angle. Therefore, the winding terminal does not suffer a large stress, so that inconvenience such as disconnection is hard to be caused. Besides, according to the above-described invention, the binding terminal is structured to protrude radially outward from the case body, preventing vertical (height) size increase.

Further, according to another invention, inconvenience such that the winding terminal bound around the extended portion and the binding terminal slips to fall is hard to occur.

According to the above-described invention, it is possible to make the case body not protrude from the drum core vertically, i.e. in a height direction of the drum core. Accordingly, the height size can be curbed. Besides, radial outside of a flange portion of the drum core is adhesively fixed to the case body, so that radial positioning and fixing of the drum core comes to be favorable.

DETAILED DESCRIPTION OF THE PREFERRED EMBODIMENT

Hereinafter, a surface mount inductor according to an embodiment of the present invention will be described based on the drawings.

Figure 1:
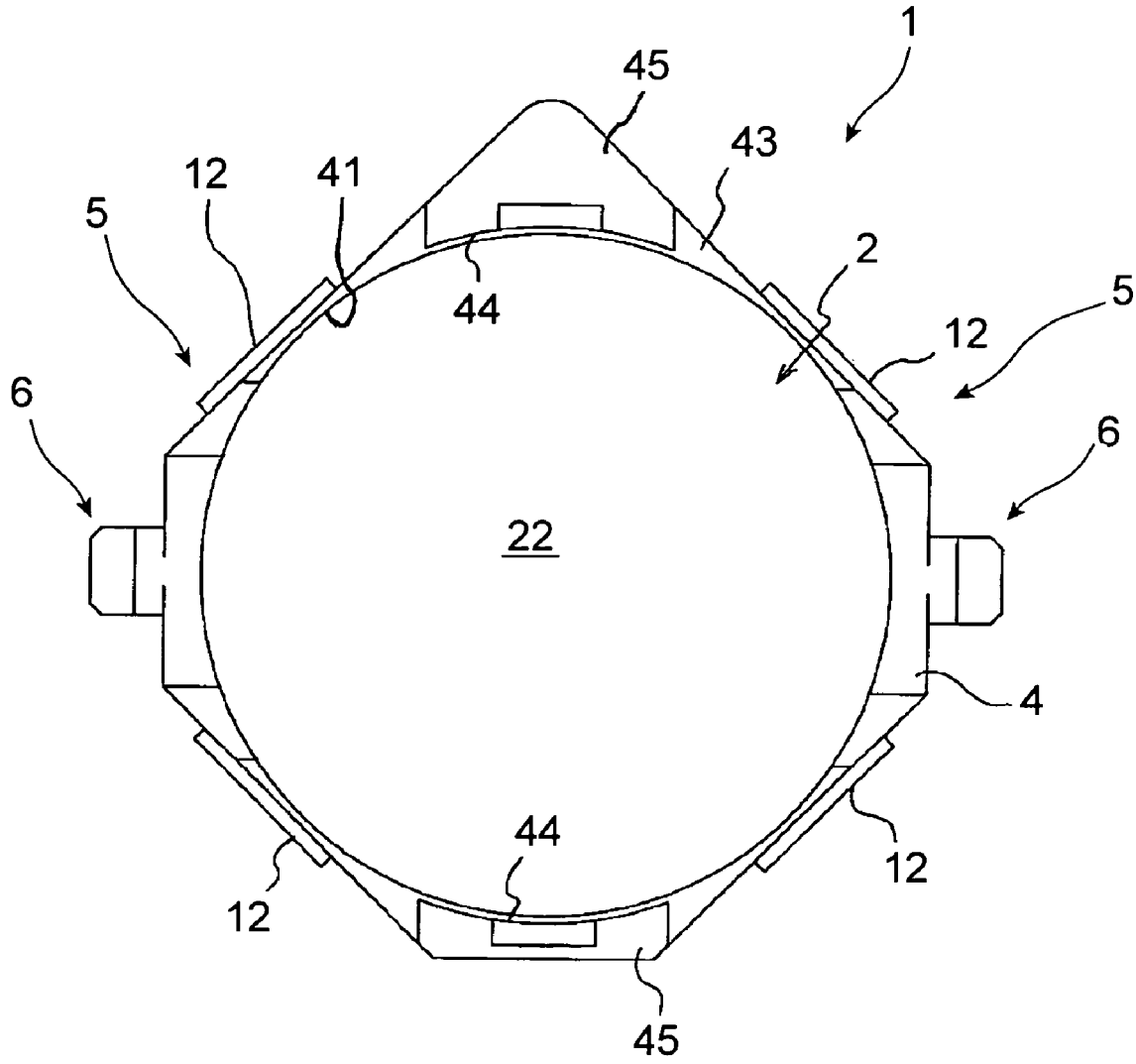
FIG. 1 is a plane view showing a surface mount inductor according to an embodiment of the present invention.
Figure 2:
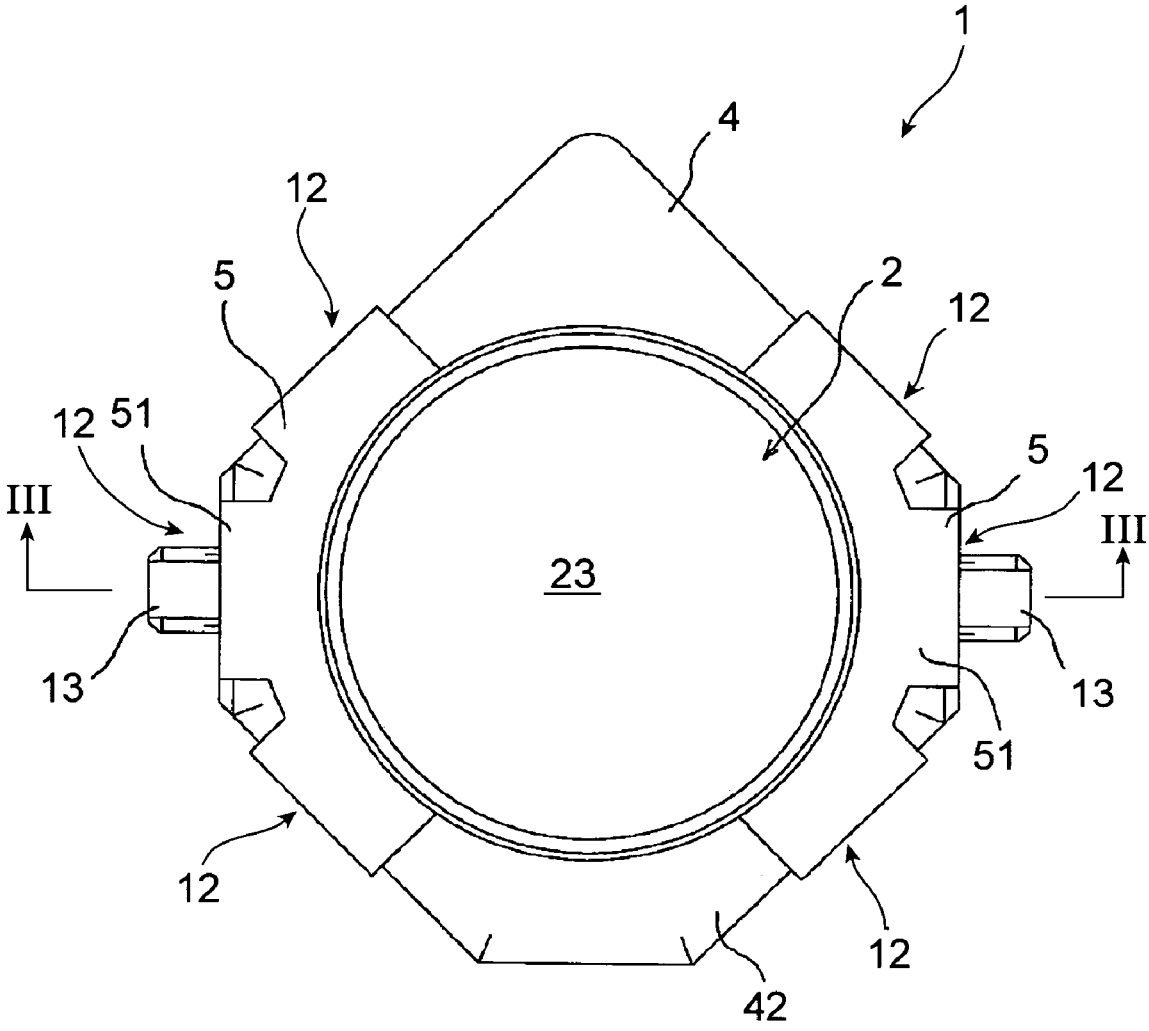
FIG. 2 is a bottom view showing the surface mount inductor shown in FIG. 1 from the reverse side.
Figure 3:
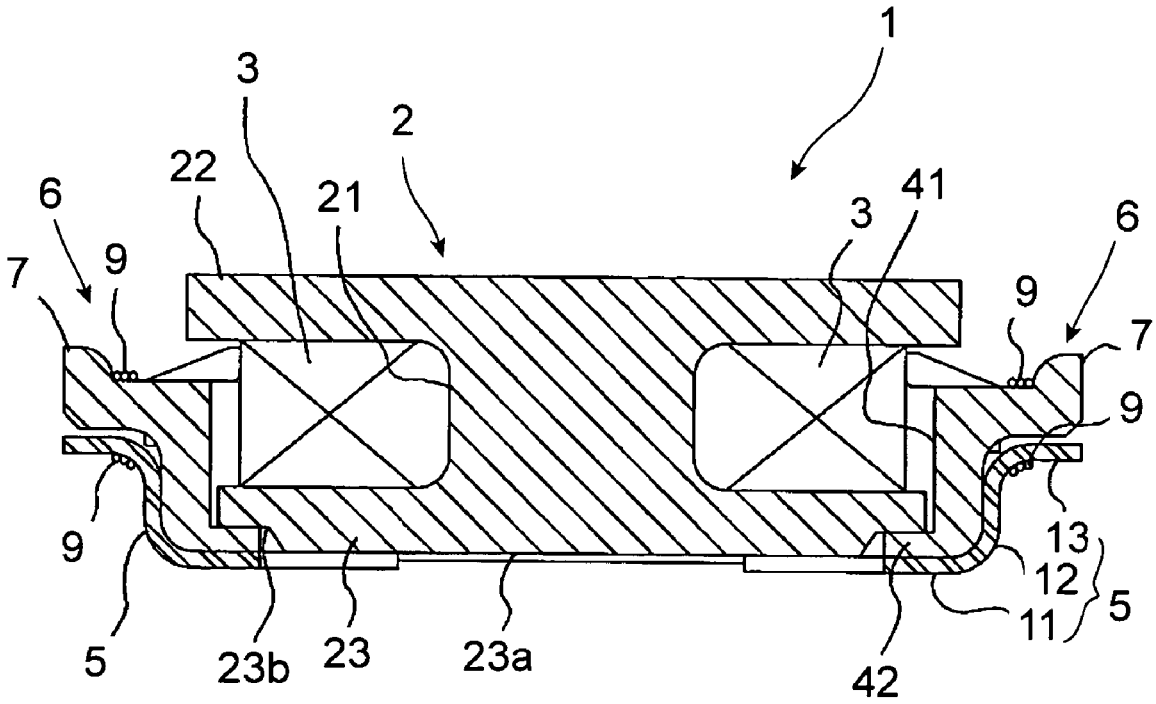
FIG. 3 is a sectional view taken along an III—III line in FIG. 2.
Figure 4:
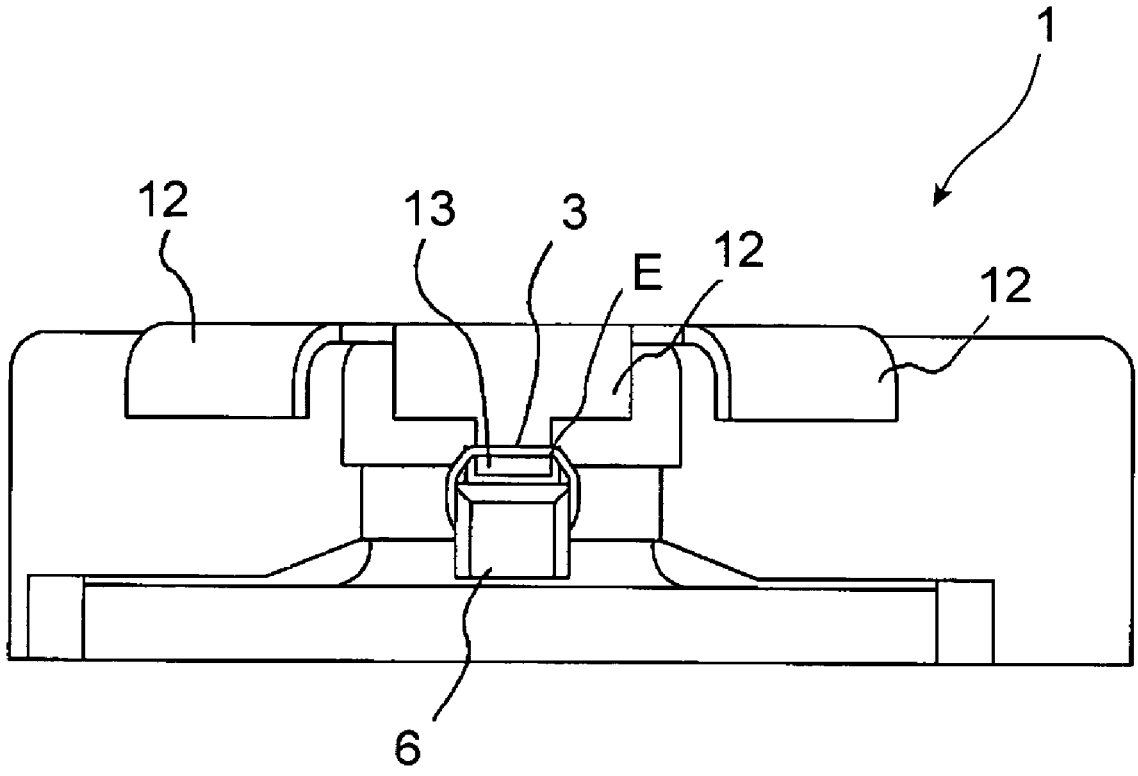
FIG. 4 is an enlarged view of a portion around which a winding terminal is to be bound.

FIG. 1 is a plane view showing the surface mount inductor according to the embodiment of the present invention. FIG. 2 is a bottom view showing the surface mount inductor shown in FIG. 1 from the reverse side. FIG. 3 is a sectional view taken along a III—III line in FIG. 2. FIG. 4 is a side view for explaining a portion to which a winding terminal is to be bound.

As shown in FIG. 1, FIG. 2, and FIG. 3, a surface mount inductor 1 includes a drum core 2 formed from ferrite or the like, a winding 3 made of copper (refer to FIG. 3), a case body 4 of nonconductive material, and a metal terminal members 5, 5.

As shown in FIG. 3, the drum core 2 is disposed inside the case body 4. The drum core 2 has a winding shaft 21, and an upper flange section 22 and a lower flange section 23 formed at both longitudinal ends of the winding shaft 21. The upper flange section 22 is structured to have a slightly larger outside diameter than that of the lower flange section 23. Over entire radial peripheral edge of an undersurface 23*a* of the lower flange section 23, there is provided a stepped portion 23*b*. Around the outer periphery of the winding shaft 21, the winding 3 is wound. For the winding wire 3, an extra fine wire having 0.35 mm in sectional diameter is used.

The case body 4 is disposed outside the drum core 2 so as to cover the outer peripheral side of the winding wire 3 and the outer periphery of the lower flange section 23. The case body 4 has a circular hole 41 for disposing the drum core 2 at the center. The drum core 2 is inserted into the circular hole 41.

At one end portion of the circular hole 41 (the lower end in FIG. 3), a flange portion 42 which is bent radially inward is formed. On the flange portion 42, the stepped portion 23*b* of the lower flange section 23 of the drum core 2 is placed. The drum core 2 is thereby positioned with regard to the case body 4 downwardly in FIG. 3. The stepped portion 23*b* has a height substantially same as the thickness of the flange portion 42, and the undersurface of the flange portion 42 and the undersurface of the lower flange section 23 of the drum core 2 are disposed on a substantially level surface.

Similarly, on the end portion of the case body 4 at the side forming the flange portion 42 (the lower end in FIG. 3), the metal terminal member 5 is fitted and fixed. The metal terminal member 5 is a part formed by punching out a flat metal member through pressing.

The metal terminal member 5 includes a planar terminal 11 of which a hidden surface is to be adhesively fixed to the flange portion 42 of the case body 4. As shown in FIG. 3, the planar terminal 11 is disposed on the undersurface side, i.e. bottom side of the surface mount inductor 1 to thereby be a contact portion with a land of a substrate (not shown) when the surface mount inductor 1 is surface mounted on the substrate. The planar terminal 11 is electrically connected and fixed to the land of the substrate by reflow soldering.

In the present embodiment, the planar terminal 11 is formed along with the outer peripheral edge of the lower flange section 23 of the drum core 2, and the inner peripheral side of the planar terminal 11 is shaped into a circular ark. Meanwhile, on the outer peripheral side of the planar terminal 11, three fixing claw portions 12 are formed by being bent at an angle of approximately 90 degrees. These three fixing claw portions 12 are inserted so as to cover the outside wall of the case body 4. Note that the bent portion forms not a right angle but a slightly rounded right angle (with a curvature raduis R).

These three fixing claw portions 12 are formed radially at an angle of approximately 45 degrees to the peripheral direction. Between respective fixing craw portions 12, there are formed hacks that are required for presswork.

Of the three fixing craw portions, the tip portion of one craw portion 12 at middle is bent further radially outward at an angle of approximately 90 degrees. This bent tip portion is thereby in parallel with the planar terminal 11 and protrudes radially outward side of the case body 4. With this protrusion, the terminal portion of the winding wire 3 is bound. Briefly, this protrusion is a binding terminal 13.

As has been described, in the present embodiment, the binding terminal 13 is protruded radially outward side of the case body 4, facilitating a binding work of the winding wire 3 with the binding terminal 13. And that, no vertical size increase is caused.

Incidentally, in the present embodiment, with intent to enhance fixing strength of the drum core 2 to the case body 4, three craw portions 12 are provided, whereas, only one craw portion 12 in the middle is acceptable if the fixing strength is not a matter.

Meanwhile, on the surface of the case body 4 at the upper side in FIG. 3 (hereinafter referred to as an "upper surface portion 43"), the outer peripheral edge portion of the undersurface of the upper flange section 22 is placed (as shown in FIG. 1). Further, on the upper surface portion 43 of the case body 4, there is provided a protrusion 45 protruding upward from the upper surface portion 43, the protrusion 45 having a core fixing surface 44.

The inner peripheral end of the core fixing surface 44 is formed of a circular ark surface along with the outer peripheral surface of the upper flange section 22 of the drum core 2. The inner peripheral end of the core fixing surface 44 is disposed to face the upper flange section 22 respectively with a slight space therebetween. With an adhesive being applied to the spaces, the upper flange section 22 of the drum core 2 is adhesively fixed to the core fixing surfaces 44 in a radially positioned state.

On the outer periphery of the case body 4, there is provided an L-shaped extended portion 6 with a hook portion 7 at its tip portion and protruding radially outside of the case body 4. This extended portion 6 is disposed at an overlapping position with the binding terminal 13 of the metal terminal member 5 in the height direction of the drum core 2 (vertical direction in FIG. 3). As shown in FIG. 2, the extended portion 6 is wider than the binding terminal 13. In other words, in the FIG. 2, the extended portion 6 is formed to have a longer vertical-length, i.e. a length on width, than that of the binding terminal 13.

Incidentally, in the present embodiment, the undersurface of the extended portion 6 is disposed to have a slight space between the upper surface of the binding terminal 13. This space is provided considering variation in size accuracy of the case body 4 made of nonconductive material, namely resin in concrete terms. It is also acceptable as a structure to closely attach the extended portion 6 to the binding terminal 13 without forming this space.

A terminal 9 of the winding wire 3 wound around the winding shaft 21 of the drum core 2 is wound from the outside of both the extended portion 6 and the binding terminal 13, which are disposed to vertically overlap with each other, as shown in FIG. 3.

In conventional arts, the winding terminal is structured to be wound only around the binding terminal. Therefore, there arises a problem that the winding terminal made of an extra fine wire osculates the edge portion of the binding terminal to cause a disconnection due to strong stress.

However, according to the present embodiment, as shown in FIG. 3 and FIG. 4, the terminal 9 of the winding wire 3 is structured to be wound around from the outside of both the extended portion 6 and the binding terminal 13. Accordingly, the terminal 9 is to osculate an edge portion E of the binding terminal 13 at an obtuse angle. As a result, the contact portion with the edge portion E of the terminal 9 does not receive strong pressure to lower tension, so that no strong stress is applied thereto. Consequently, the surface mount inductor 1 according to the present embodiment is hard to cause inconvenience such as disconnection due to the osculation of the terminal 9 of the winding wire 3 with the edge portion E.

The present invention is particularly suitable for a minute surface mount inductor to be built in a portable terminal device such as a portable telephone, PDA (personal digital assistant), and the like.

What is claimed is:

1. A surface mount inductor having a drum core, a winding to be wound around a winding shaft section of said drum core, a case body of a nonconductive material to be disposed so as to surround said winding, comprising:

a metal terminal member having a binding terminal and a planar terminal;

said metal terminal member being adhesively fixed to said case body;

said binding terminal bound by a terminal end of said winding;

an undersurface side of said planar terminal to be a contact portion for contact with a substrate;

a hidden surface of said planar terminal to be a contact portion for contact with said case body; and an extended portion protruding radially outward from said case body and having a wider width than or approximately the same width as that of said binding terminal, said extended portion being disposed at an overlapping position with said binding terminal in a height direction of the drum core, wherein the terminal of said winding is wound around from the outer peripheral side of both said binding terminal and said extended portion.

2. The surface mount inductor according to claim 1, further comprising a hook portion for preventing said winding terminal from slipping, which is provided at a radially outward end portion of the extended portion.

3. The surface mount inductor according to claim 1, further comprising a fixing surface for adhesively fixing the drum core by abutting from radially outside to a flange section of the drum core, which is provided at an end portion of the case body opposite to the end portion to which said metal terminal member is to be fixed.

4. The surface mount inductor according to claim 2, further comprising a fixing surface for adhesively fixing the drum core by abutting from radially outside to a flange section of the drum core, which is provided at an end portion of the case body opposite to the end portion to which said metal terminal member is to be fixed.

* * * * *